US005970951A

United States Patent [19]

Ito

[11] Patent Number: 5,970,951

[45] Date of Patent: Oct. 26, 1999

[54] OVER-REV RESTRICTION SYSTEM FOR ENGINE POWERING A PERSONAL WATERCRAFT

[75] Inventor: Kazumasa Ito, Iwata, Japan

[73] Assignee: Yamaha Hatsudoki Kabushiki Kaisha, Iwata, Japan

[21] Appl. No.: 08/982,217

[22] Filed: Dec. 1, 1997

[30] Foreign Application Priority Data

Nov. 29, 1996 [JP] Japan ..... 8-359799

[51] Int. Cl.[6] ..... F91N 3/28

[52] U.S. Cl. ..... 123/335; 123/333; 123/198 D

[58] Field of Search ..... 123/333, 334, 123/347, 335, 481, 198 D

[56] References Cited

U.S. PATENT DOCUMENTS 4,385,601 5/1983 Orova et al. ..... 123/335
4,951,624 8/1990 Hirano ..... 123/198 D
5,161,503 11/1992 Yano et al. ..... 123/335
5,335,744 8/1994 Takasuka et al. ..... 123/333
5,669,349 9/1997 Iwata et al. ..... 123/335

*Primary Examiner*—Willis R. Wolfe
*Assistant Examiner*—Mahmoud M. Gimie
*Attorney, Agent, or Firm*—Knobbe, Martens, Olson & Bear LLP

[57] ABSTRACT

An engine speed restriction system for an internal combustion engine having at least two combustion chambers, an ignition system including an ignition element corresponding to said combustion chamber, and an engine speed sensor is disclosed. The system is arranged to reduce a speed of the engine if the engine speed exceeds a predetermined speed, the system including a control for disabling a first number of combustion chambers if the engine speed exceeds a first speed and for disabling a second number of combustion chambers if the engine speed exceeds a second engine speed, the second number of combustion chambers exceeding the first number of combustion chambers and the second engine speed exceeding the first engine speed

15 Claims, 8 Drawing Sheets

OVER-REV RESTRICTION SYSTEM FOR ENGINE POWERING A PERSONAL WATERCRAFT

FIELD OF THE INVENTION

The present invention relates to an internal combustion engine. More particularly, the invention is an engine speed or "rev" restriction system an engine.

BACKGROUND OF THE INVENTION

Watercraft, especially those of the type known as personal watercraft, are commonly powered by internal combustion engines positioned within their hulls. These engines are arranged to drive a water propulsion device for propelling the craft.

The engine typically has at least one cylinder in which is movably mounted a piston. The piston is connected to a crankshaft which is mounted for rotation with respect to the remainder of the engine. Combustion of fuel within the cylinder moves the piston, which in turn effectuates rotation of the crankshaft.

As is well known, it is generally undesirable for the speed of the engine to exceed a predetermined high speed. The engine speed is normally measured by the number of revolutions per minute which the crankshaft turns.

In order to limit the engine speed, a number of engine speed or "rev" limiting arrangements have been proposed. In a common arrangement, the ignition firing timing is delayed (i.e. retarded) so that less time is provided for combustion in the cylinder before the exhaust cycle. Unless the ignition firing timing is substantially delayed to the point where misfiring is occurring, this method of limiting the engine speed is not always particularly effective. In addition, the exhaust system associated with many watercraft engines includes an exhaust catalyst. When the ignition firing timing is delayed, continued combustion may occur in the exhaust system when a combusting air and fuel mixture is exhausted, damaging the catalyst.

In another arrangement, the ignition system for the engine may be shut off. In this arrangement, the ignition elements do not fire, preventing combustion in the cylinders. This arrangement has the detriment that the engine is stopped as the engine speed exceeds a predetermined speed, and once the engine speed falls below the predetermined speed it is again started but may need to immediately be shut off again as the engine speed surges higher. This fluctuation between engine operation and nonoperation results in very rough watercraft operation for the rider.

An improved engine speed or "rev" restriction system for an engine powering a watercraft is desired.

SUMMARY OF THE INVENTION

In accordance with the present invention there is provided an engine speed restriction system for an internal combustion engine having at least two combustion chambers. Preferably, the engine is of the type having an ignition system including an ignition element corresponding to each combustion chamber. The engine also includes a means for sensing the speed of said engine, such as a crankshaft rotation sensor.

The speed restriction system is arranged to reduce a speed of the engine if the engine speed exceeds a predetermined speed. Preferably, the system is arranged to disable the ignition elements with a first disabling factor when the engine speed is less than the predetermined speed, and for disabling the ignition elements in accordance with an increased second disabling factor when the engine speed exceeds the predetermined speed. The disabling factors may be applied to entirely disable one or more cylinders or to simply prevent the firing of the ignition elements associated with all cylinders at certain times.

In a preferred arrangement, the system is arranged to delay the firing timing of the ignition elements when the speed of the engine reaches a speed just below the predetermined speed. Also, the system is preferably arranged to advance the ignition firing timing of the fired ignition elements when the engine speed exceeds the predetermined speed.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an engine speed restriction system. Since the speed of the engine is generally measured by the number of revolutions per minute of a crankshaft or output shaft thereof, such a restriction system is generally referred to as a revolution or "rev' restriction system. The over-rev restriction system of the present invention is arranged to reduce the speed of the engine in the event the engine speed exceeds a predetermined speed.

The system of the present invention is described for use with an engine powering a water propulsion device of a personal watercraft, since this is an application for which the system has particular utility. Those of skill in the art will appreciate that the system may be used with engines in a wide variety of other applications.

Figure 1:
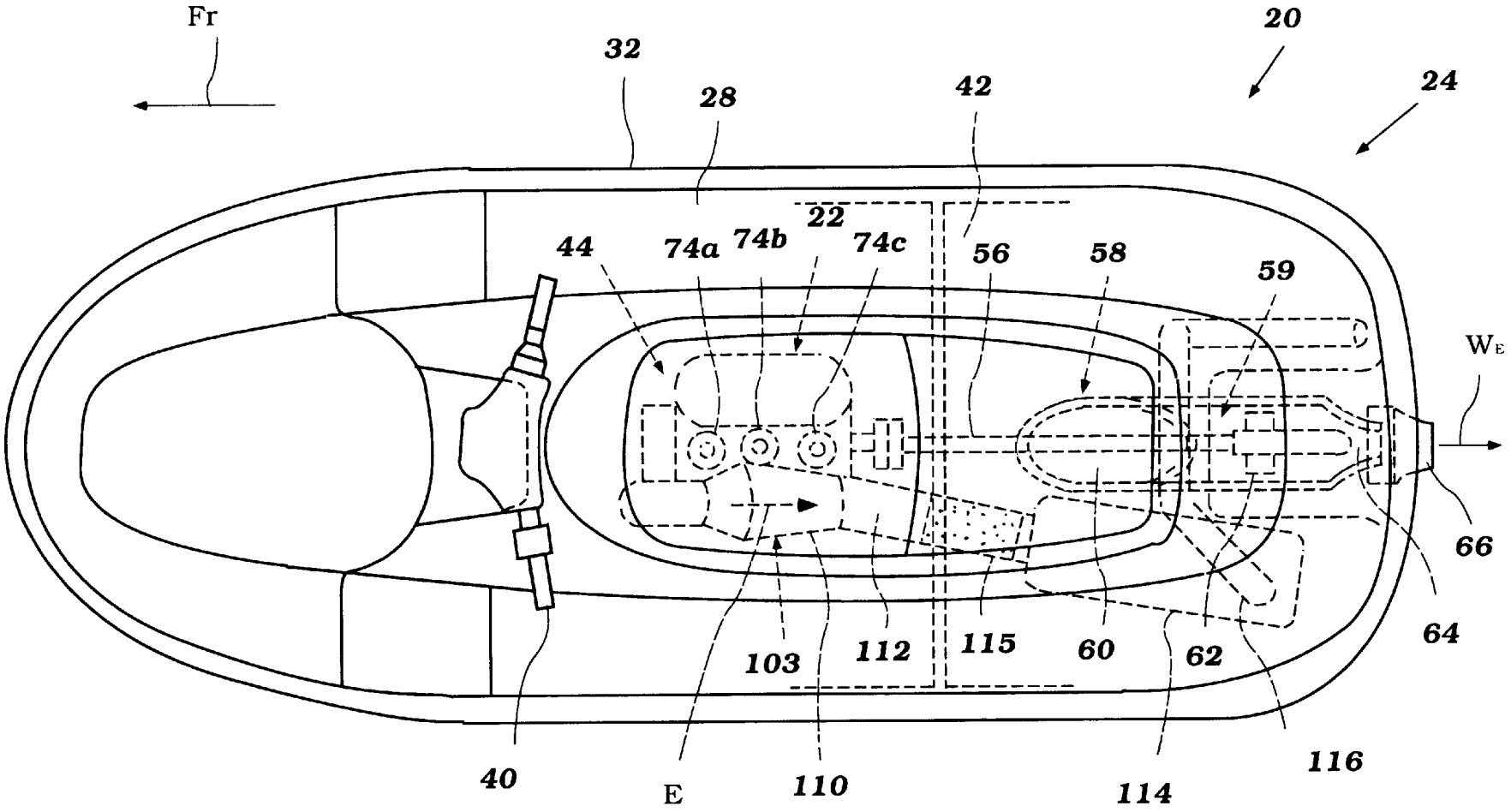
FIG. 1 is a side view of a personal watercraft of the type powered by an engine, the engine and other watercraft components positioned within a hull of the watercraft illustrated in phantom.
Figure 2:
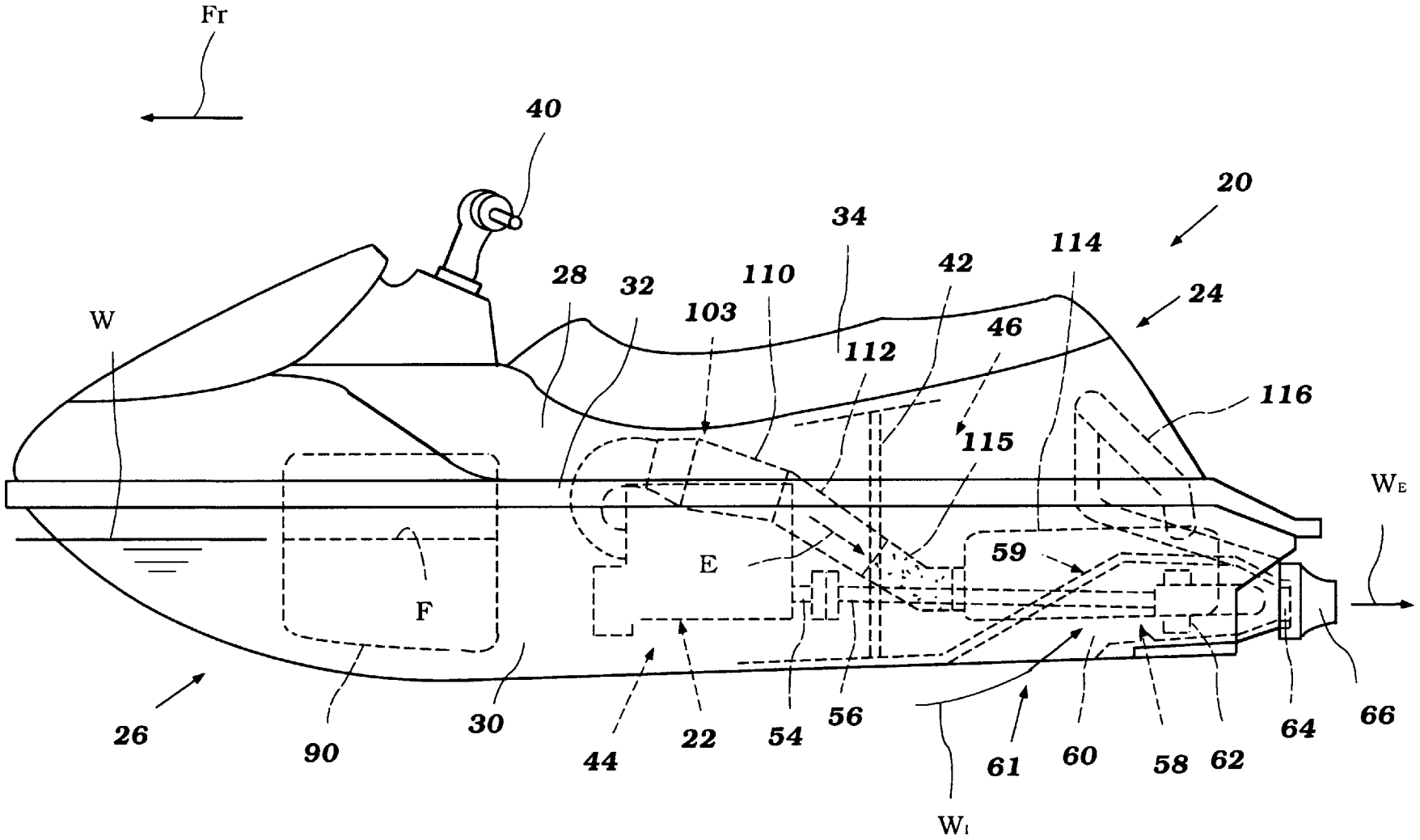
FIG. 2 is a top view of the watercraft illustrated in FIG. 1, with the engine and other watercraft components positioned within the hull of the watercraft illustrated in phantom.

FIGS. 1 and 2 illustrate a personal watercraft 20 having a watercraft body 24 comprising a hull 26 having a top portion or deck 28 and a lower portion 30. A gunnel 32 defines the intersection of the hull 26 and the deck 28.

A seat 34 is positioned on the top portion 28 of the hull 26. The seat 34 may be connected to a removable deck member for use in accessing an engine compartment within the hull 26, as described in more detail below. A steering handle 40 is provided adjacent the seat 34 for use by a user in directing the watercraft 20.

Figure 3:
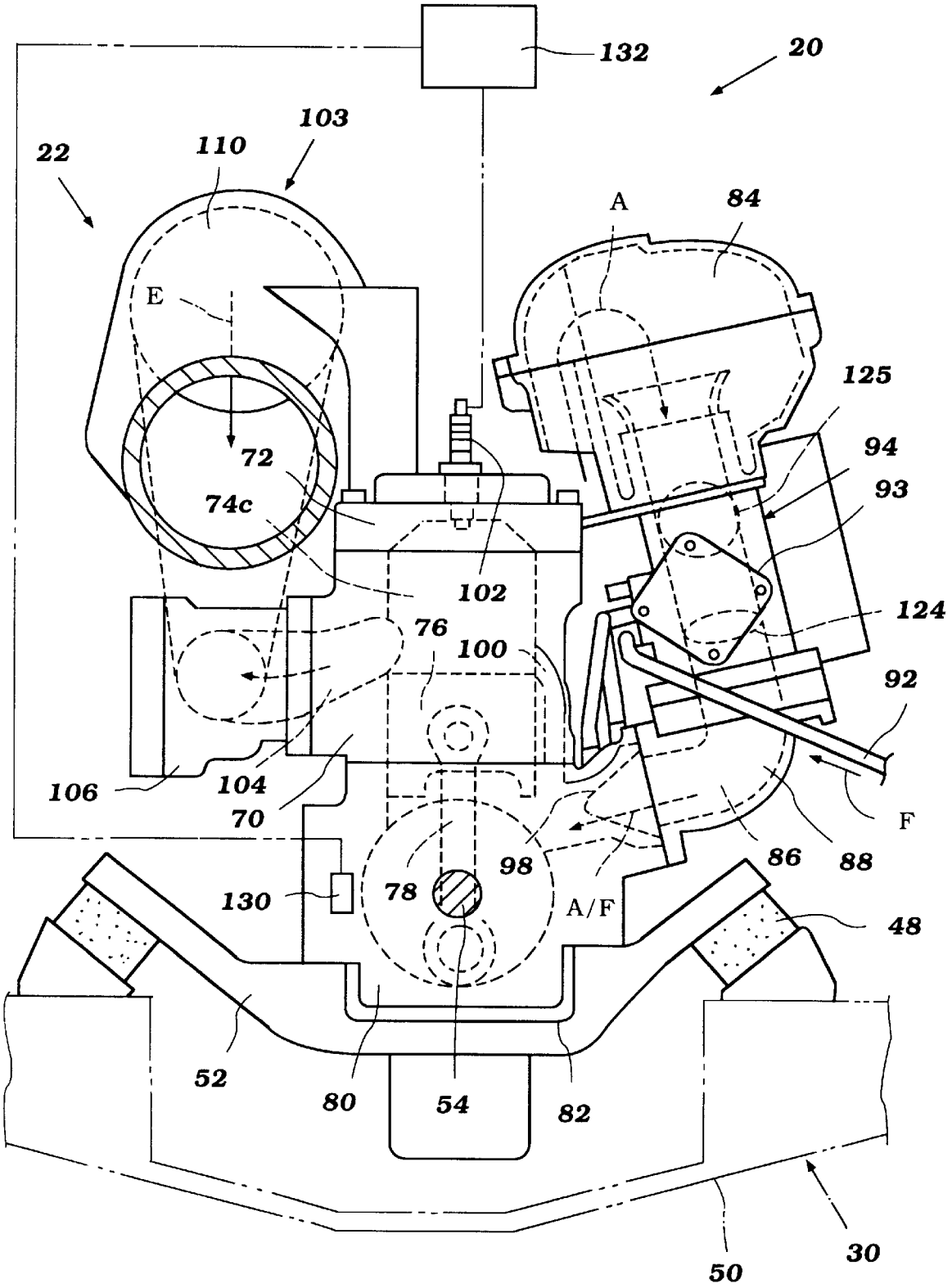
FIG. 3 is an end view, in partial cross-section, of the engine illustrated in FIG. 1.

The top and bottom portions 28,30 of the hull 26, along with a bulkhead 42, define an engine compartment 44 and a pumping chamber 46. An engine 22 is positioned in the engine compartment 44. As best illustrated in FIG. 3, the engine 22 is connected to the hull 26 via several engine mounts 48 connected to a bottom 50 of the lower portion 30 of the hull 26. The mounts 48 connect an engine support plate 52 to the hull 26. Preferably, the engine mounts 48 include at least one section comprising a material for damping vibration transmission between the hull 26 and engine 22. The engine 22 is preferably partially accessible through a maintenance opening accessible by removing the removable deck member on which the seat 34 is mounted.

The engine 22 has a crankshaft 54 (see FIG. 1) which is in driving relation with an impeller shaft 56. The impeller shaft 56 rotationally drives a means for propelling water of a propulsion unit 58, which unit extends out a stern portion of the watercraft 20 (i.e. that end of the watercraft 20 opposite the front end which faces in the direction Fr in FIG. 1).

The propulsion unit 58 includes a water pipe 59 which defines a propulsion passage 60 having an intake port 61 which extends through the lower portion 30 of the hull 26 through which water is drawn in the direction $W_I$. The means for propelling water, preferably an impeller 62 driven by the impeller shaft 56, is positioned in the passage 60. The passage 60 also has an outlet 64 positioned within a nozzle 66. The nozzle 66 is movably mounted, with the position thereof controlled by the steering handle 40, whereby the rider may direct expelled water $W_E$ under force in a variety of directions to steer the watercraft 20.

The engine 22 is best illustrated in FIG. 3. As illustrated therein, the engine 22 preferably has three cylinders 74*a,b,c*, arranged in an in-line configurations and operates on a two-cycle principle. Of course, the engine 22 may have as few as one, or more than three, cylinders, as may be appreciated by one skilled in the art. In addition, the engine may operate on a four-cycle or other operating principle.

The engine 22 includes a cylinder block 70 having a cylinder head 72 connected thereto and cooperating therewith to define the three cylinders 74*a,b,c*. A combustion chamber is defined within each cylinder 74*a,b,c*, by a cylinder wall within the block 70, a recessed area in the cylinder head 72, and the head of a piston 76. A piston 76 is movably mounted in each cylinder, and connected to the crankshaft 54 via a connecting rod 78, as is well known in the art.

The crankshaft 54 is rotatably joumalled by a number of sealed bearings with respect to the cylinder block 70 within a crankcase chamber 80. Preferably, the chamber 80 is defined by a crankcase cover member 82 which extends from a bottom portion of the cylinder block 70. As is well known, the crankshaft 54 has pin portions extending between web portions thereof, with each connecting rod 78 connected to one of the pin portions and the web portions rotatably supported by the bearings mounted to members extending from the block 70 and cover 82.

As illustrated in FIG. 3, the engine 22 includes means for providing an air and fuel mixture to each cylinder 74*a,b,c*. Preferably, air is drawn into the engine compartment 44 through one or more air inlets in the hull 26. Air A is then drawn through an air intake box 84 and delivered through an intake passage 86 in an intake manifold 88 leading to the engine 22.

Fuel is provided to each cylinder 74*a,b,c* for combustion. Preferably, fuel is combined with the incoming air. In particular, fuel F is drawn from a fuel tank 90 (see FIG. 1) positioned in the engine compartment 44 by a fuel pump 93 and delivered through a fuel delivery line 92 to a charge former such as a carburetor 94 (see FIG. 3). The fuel pump 93 is preferably a diaphragm operated variety. Preferably, changes in air pressure within the crankcase operate the pump 93.

The carburetor 94 is preferably positioned between the air intake box 84 and the intake manifold 88. The carburetor 94 defines a passage through which air selectively flows from the box 84 to the passage 86 in the intake manifold 88.

Figure 4:
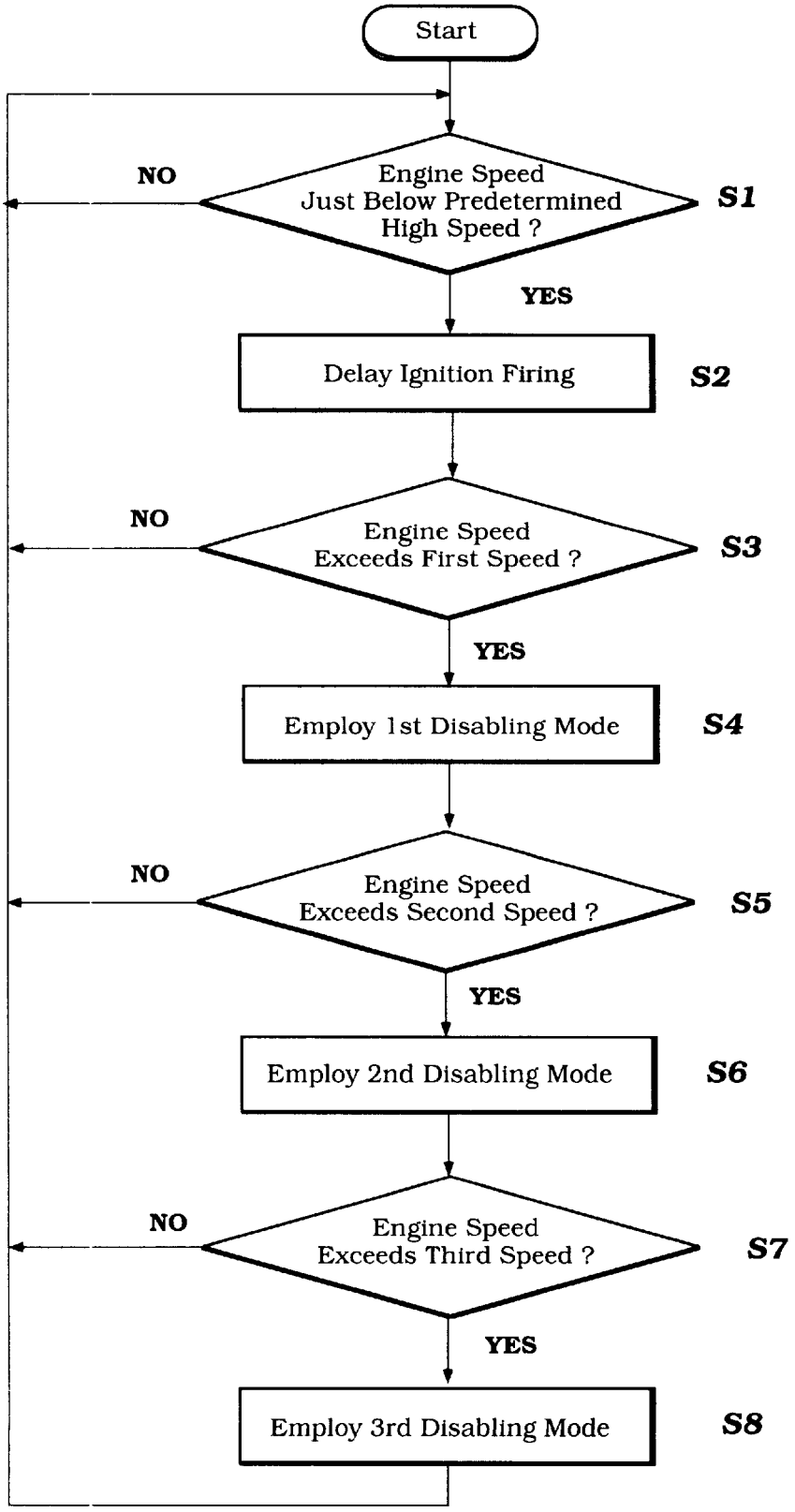
FIG. 4 is a flow chart illustrating the over-rev restriction system of the present invention for use in the controlling the engine speed of the engine illustrated in FIGS. 1–3.

Referring to FIGS. 3 and 4, a throttle valve 124 and a choke valve 125 are preferably provided in the passage through the carburetor 94 for allowing the watercraft operator to control the rate of fuel and air delivery to the engine 22 and thus the speed and power output of the engine. Preferably, the throttle and choke valves 124,125 are controlled remotely by a rider of the watercraft 20 via a throttle linkage and choke linkage of the carburetor 94.

Fuel which is delivered to the carburetor 94 but not delivered to the air flowing therethrough may be returned to the fuel tank 90 through a return line. It is contemplated that the fuel may be provided to the engine by indirect or direct fuel injection, as well as via carburation, as known in the art.

The air and fuel mixture (labeled A/F in FIG. 3) selectively passes through an intake port into the crankcase chamber 80 as controlled by a reed valve 98, as is known in the art. As is also well known, an intake port and corresponding reed valve 98 are preferably provided corresponding to each cylinder 74*a,b,c*. Likewise, the crankcase chamber 80 is compartmentalized so as to provide a crankcase compression area corresponding to each cylinder 74*a,b,c*.

As is well known in the operation of two-cycle engines, when the piston 76 corresponding to a given cylinder 74*a,b,c* moves upwardly, air and fuel are drawn through the reed valve 98 into the crankcase chamber area corresponding to that cylinder. As the piston 76 moves downwardly, the reed valve 98 prevents a backflow of air and fuel through the intake port, causing the air and fuel mixture to be compressed. This mixture ultimately flows through at least one scavenge passage 100 leading from the crankcase compression area to one or more scavenge ports in the cylinder wall.

A suitable ignition system is provided for igniting the air and fuel mixture provided to each combustion chamber. Preferably, this system includes a spark plug 102 corresponding to each cylinder 74*a,b,c*. Each spark plug 102 is preferably fired by a suitable ignition system, described in more detail below.

Though not illustrated, the engine 22 may include a flywheel connected to one end of the crankshaft 54 and having a number of magnets thereon for use in a generator arrangement for generating power for an ignition coil and for use in a generator arrangement for generating power for an ignition coil and for use in a pulser-coil arrangement for generating firing signals for the ignition system. In addition, the ignition system may include a battery for use in providing power to an electric starter and other electrical engine features. A number of teeth may be mounted on the periphery of the flywheel for use in starting the engine 22 with the electrically powered starter motor (not illustrated).

The engine 22 also preferably includes a lubricating system for providing lubricating oil to various parts thereof, and a cooling system for cooling the engine. These systems are well known to those of skill in the art.

Still referring to FIG. 1, exhaust gas E generated by the engine 22 is routed from the engine to a point external to the watercraft 20 by an exhaust system 103 which includes an exhaust passage 104 leading from each cylinder 74*a,b,c* through the cylinder block 70.

An exhaust manifold 106 is connected to a side of the engine 22. The manifold 106 has three branches with passages leading therethrough (corresponding to the three cylinders chambers 74*a,b,c*) aligned with the passages 104 leading through the cylinder block 70. Exhaust generated by each cylinder 74*a,b,c* is routed through a respective passage 104 to the manifold 106.

The manifold 106 includes a merge portion at which the passages through the individual branches merge into a single passage. This merge portion of the manifold leads to an expansion pipe 110 positioned generally above the engine 22. The expansion pipe 110 has an enlarged passage or chamber through which exhaust routed from the passage in the exhaust manifold 106 flows.

Referring to FIGS. 1 and 2, exhaust flows from the expansion pipe 110 into an upper exhaust pipe section 112 of the exhaust system. This portion of the exhaust system is tapers to a smaller diameter from that of the expansion pipe 110. This exhaust pipe 112 leads to a water lock 114. The exhaust pipe 112 is preferably connected to the water lock 114 via a flexible fitting, such as a rubber sleeve 115. The exhaust flows through the water lock 114, which is preferably arranged as known to those skilled in the art, and then passes to a lower exhaust pipe 116 which discharges into the body of water at the stern of the craft 20. In this manner, exhaust flows from the engine 22 through the exhaust system and into the body of water in which the watercraft 20 is positioned. A catalyst (not shown) may be positioned within the exhaust system 103 for catalyzing the exhaust gases.

Means (not shown) are provided for controlling the flow of exhaust gases through the exhaust passages 104 from the cylinders 74*a,b,c*. This means may comprise a sliding knife, rotating or other type valve, and means for moving the valve in a timed manner, as well known to those skilled in the art.

In accordance with the present invention, means are provided for limiting the speed of the engine 22. Preferably, an engine speed sensor 130 provides engine speed data to an ignition control 132. As illustrated, the speed sensor 130 comprises a crankshaft 54 rotation sensor which provides crankshaft rotational speed data. This data is provided to the ignition control 132, which is arranged to control the firing of each ignition element.

The ignition control 132 is operated in accordance with an over-rev restriction system of the present invention. A rev-restriction system in accordance with a first embodiment of the present invention will be described in conjunction with FIGS. 4–6.

In general, this system includes a means for disabling a first number of cylinders when a speed of the engine exceeds a first speed and for disabling a second number of cylinders greater than the first number of cylinders when the engine speed exceeds a second speed which exceeds the first speed.

In particular, once the engine 22 is running, the control 132 is arranged to detect whether the engine speed reaches an engine speed just below a predetermined high speed (step S1). In the embodiment illustrated, the predetermined high speed is 7100 rpm, and the engine speed just below this speed which is monitored is 6900 rpm. If the engine speed (as detected by the sensor 130) has not reached the speed just below the predetermined speed, the control 132 simply continues to monitor the engine speed.

Figure 5:
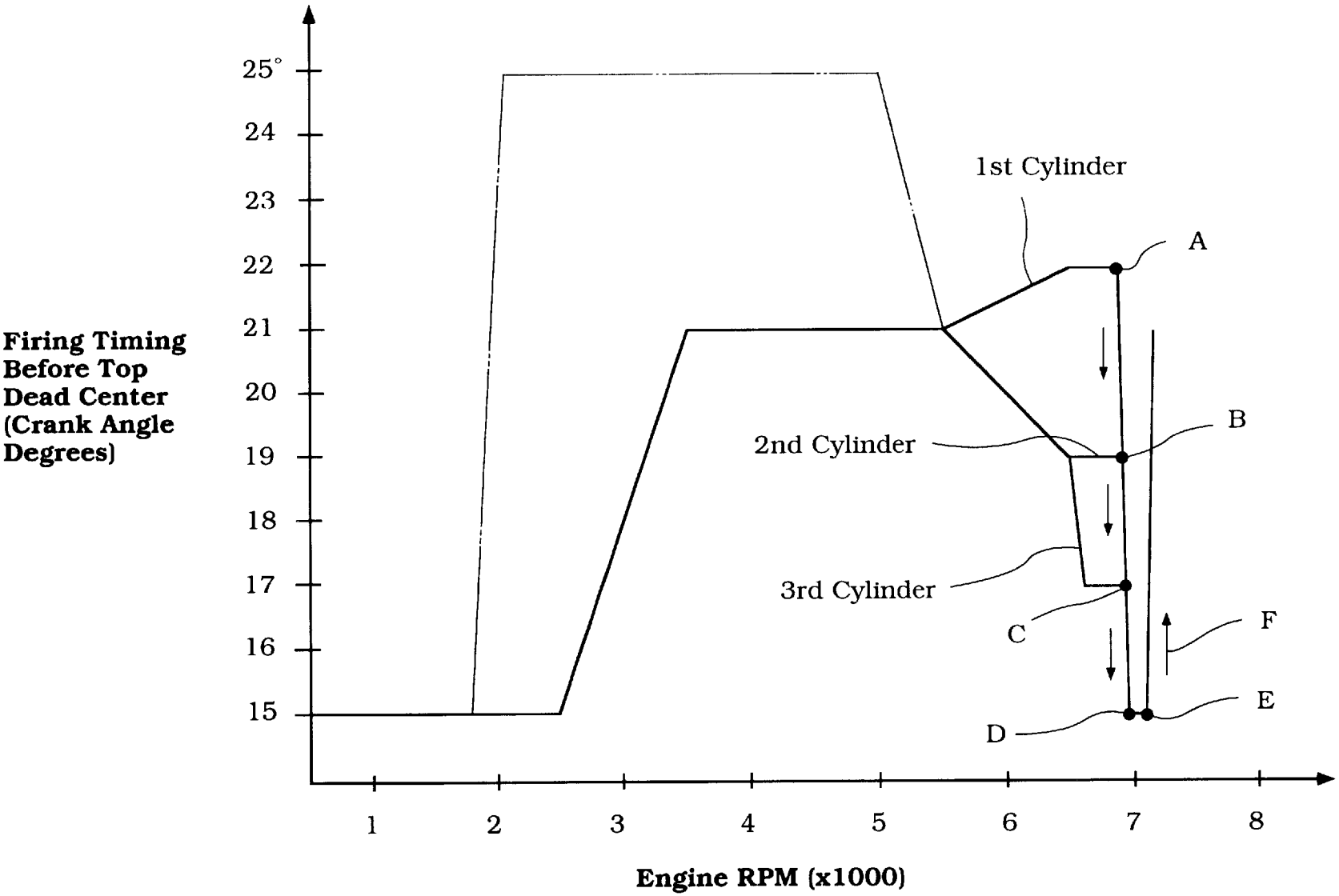
FIG. 5 is a graph illustrating engine speed versus firing timing for an engine controlled in accordance with the system illustrated in FIG. 4.
Figure 6:
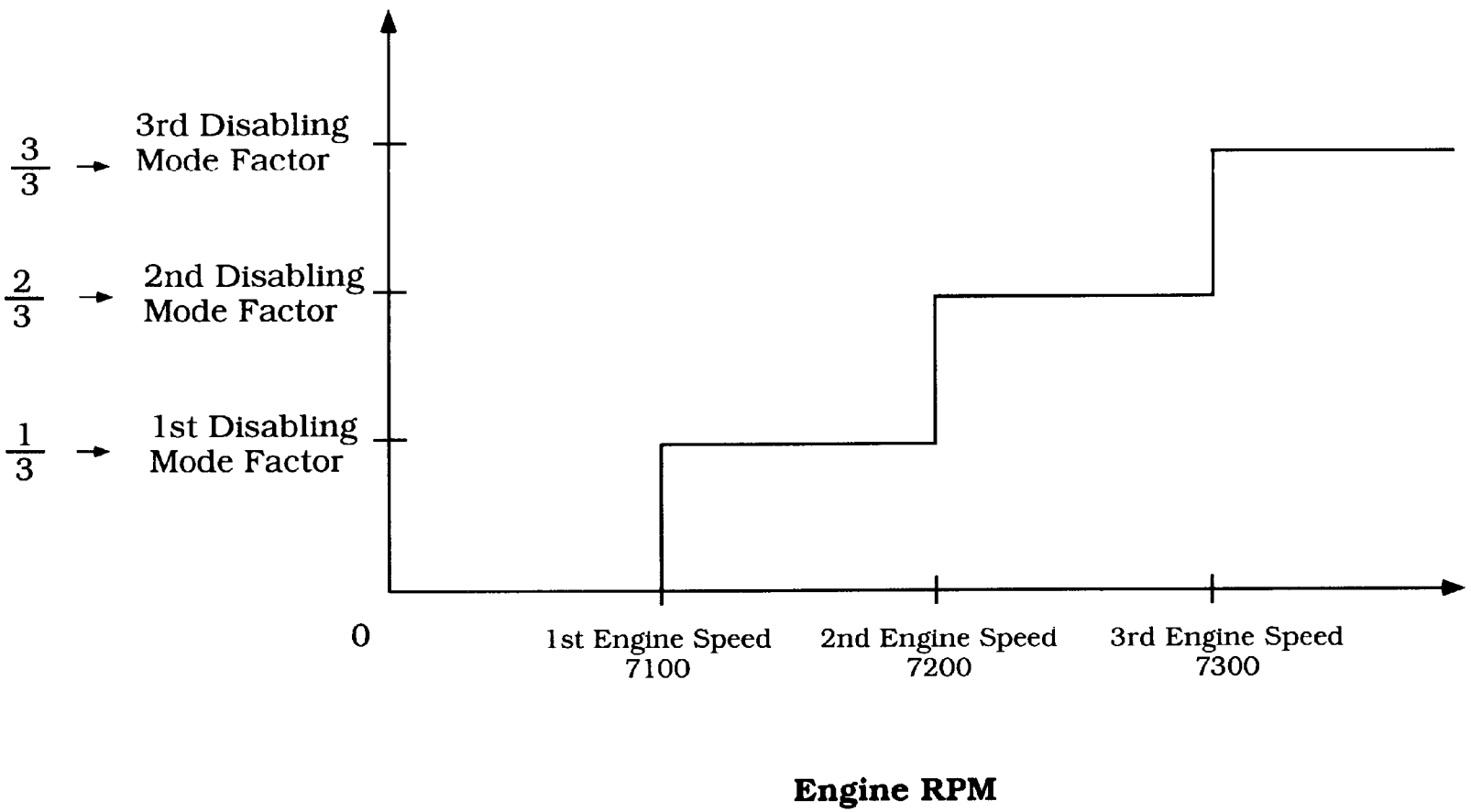
FIG. 6 is a graph illustrating engine speed versus a disabling factor for an engine controlled by the system illustrated in FIG. 4.

If the engine speed exceeds this speed just below the predetermined speed, then the control 132 is arranged to delay (i.e. retard) the ignition firing timing (step S2). As illustrated in FIG. 5, the filing timing of the first, second and third cylinders 74*a,b,c* as the engine speed reaches the speed just below the predetermine high speed may be 22, 19 and 17 degrees before top dead center (BTDC), respectively (corresponding to points A, B and C). Once the engine speed reaches the speed just below the predetermined high speed, the firing timing of the cylinders 74*a,b,c*, is delayed, such as to 15 degrees BTDC (corresponding to point D). This has the effect of slightly shortening the total combustion time for each cylinder.

In a step S3, the engine speed is then checked to determine if it has exceeded the predetermined speed (7100 rpm in this embodiment). If not, then the system continues to delay ignition timing if the engine speed is above the speed just below the predetermined high speed, or if the engine speed is below this speed, then a normal ignition firing timing is employed.

If the engine speed rises and exceeds the predetermined high or first speed (7100 rpm), then the system is arranged so that the control 132 employs a first disabling mode (step S4). Here, the control 132 is arranged to disable the cylinders in accordance with a first disabling mode factor which exceeds a disabling factor which was applied when the engine speed was less than the predetermined high speed. In this embodiment, the disabling factor when the engine speed is less than the predetermined speed is zero, with no ignition firings prevented, and in the preferred embodiment when the engine speed reaches the predetermined first speed, the disabling factor is increased to the first factor, which is preferably ⅓. In a first arrangement of this embodiment, this factor is applied to disable one of the cylinders entirely (i.e. one of the three cylinders), such as the first cylinder 74*a*. By disabling, it is generally meant that the ignition element associated with that cylinder is prevented from firing, thus preventing combustion in that cylinder completely. In a second arrangement of this embodiment, the factor is applied to disable the firing associated with all of the cylinders ⅓ of the time, i.e. the ignition elements for all three cylinders 74*a,b,c* are prevented from firing every third time that they would normally fire.

In addition, in this first mode the control 132 increases the ignition firing timing (i.e. advance the firng) of all cylinders which remaining firing (i.e. all three cylinders if the factor is applied to prevent firing only ⅓ of the time, or the remaining two cylinders when one cylinder is completely disabled), such as from 15 degrees BTDC to 20 degrees BTDC (in the direction F from point E as illustrated in FIG. 5). In this manner, the cylinders which remain firing after application of the first factor are arranged to fairly completely burn their fuel and air charges so as to prevent back-firing in the exhaust system.

If the engine speed is reduced through implementation of this first disabling mode, then the system rechecks the engine speeds as described above. If the engine speed continues to rise above a second predetermined high speed above the first predetermined speed (such as 7200 rpm), as checked in a step S5, the system employs a second disabling mode (step S6). In this second mode, the control 132 is arranged to disable the cylinders in accordance with a second disabling mode factor. In this embodiment, the second factor is preferably ⅔. In a first arrangement, the factor is applied to disable two of the cylinders entirely (i.e. two of the three cylinders are disabled), such as the first and second cylinders 74*a,b*. In a second arrangement, the factor may be applied to prevent the firing of the ignition element associated with all of the cylinders 74*a,b,c* ⅔ of the time, or to prevent firing of the ignition element of each cylinder 2 of each 3 times the ignition element would normally fire. In addition, in this third mode the control 132 maintains the advanced firing timing of the cylinders which are being fired.

If the engine speed is reduced through implementation of this second disabling mode, then the system rechecks the engine speeds as described above. If the engine speed continues to rise above a third predetermined high speed above the second predetermined speed (such as 7300 rpm), as checked in a step S7, the system employs a third disabling mode (step S8). In this third mode, the control 132 is arranged to disable the cylinders in accordance with a third disabling mode factor. In this embodiment, the third factor is preferably ⅔, such that all of the cylinders 74*a,b,c* are disabled entirely by preventing the firing of their ignition elements all of the time.

Once the engine speed falls, the system is arranged to monitor the engine speed and then employ the above-stated steps.

Figure 7:
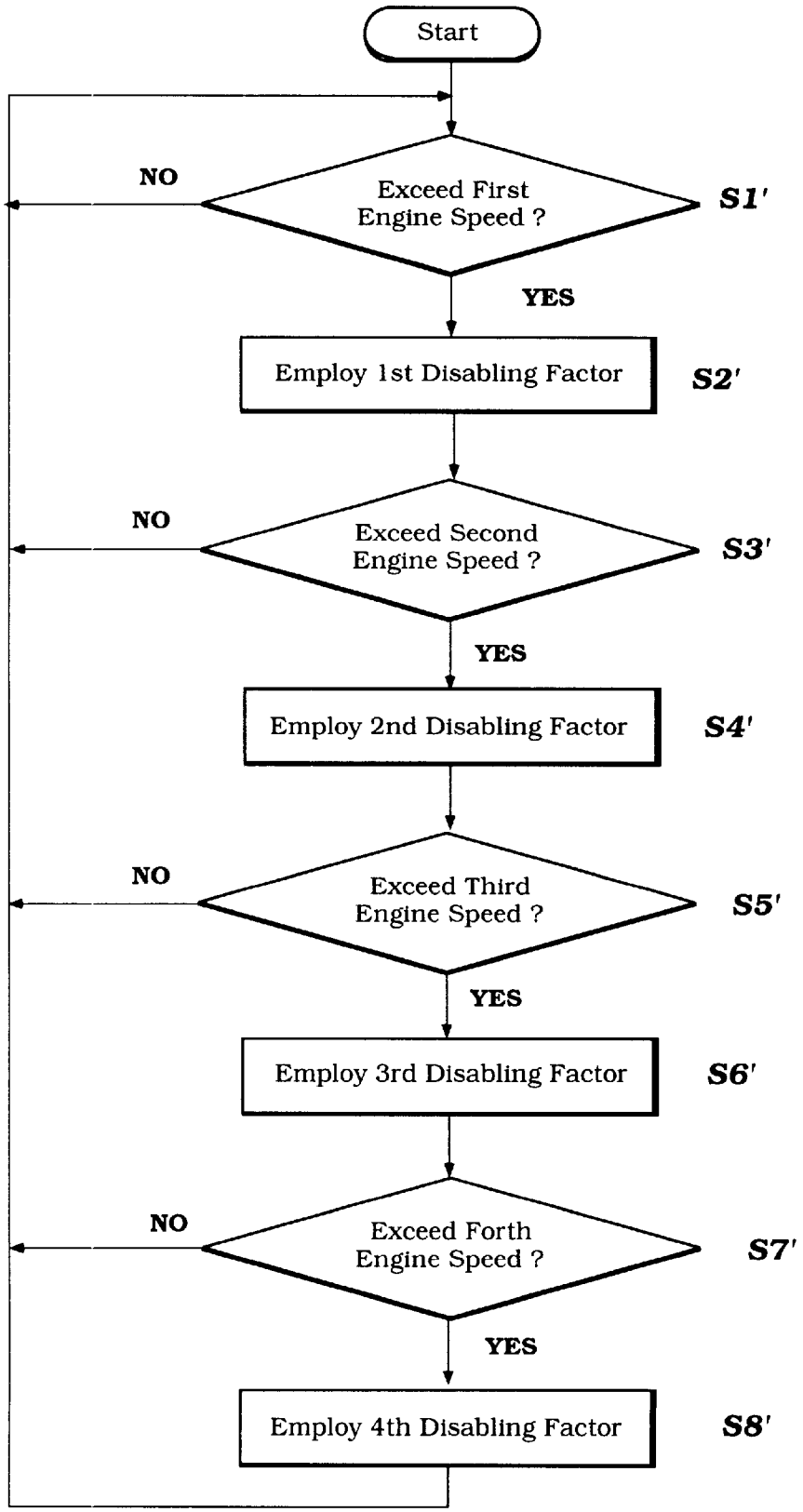
FIG. 7 is a flow chart illustrating an over-rev restriction system in accordance with a second embodiment of the present invention.
Figure 8:
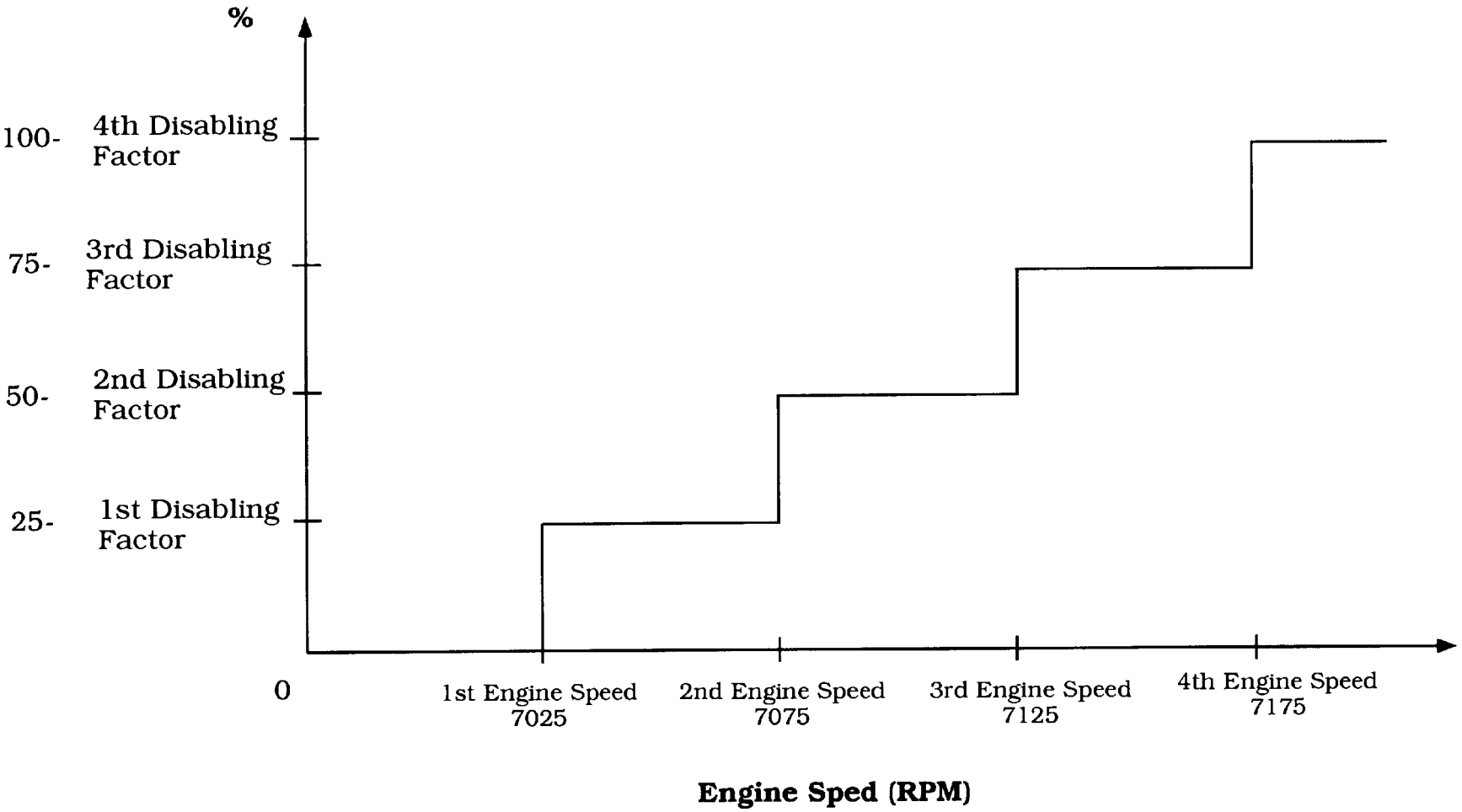
FIG. 8 is a graph illustrating engine speed versus a disabling factor for an engine controlled by the system illustrated in FIG. 7.

This system has the advantage that the cylinders are not all disabled in the first instance when the engine speed reduction system takes effect. Instead, the firing frequency of the cylinders is decreased or the number of cylinders disabled is increased only as the engine speed continues to rise, so that the engine operates fairly smoothly. An over-rev restriction system in accordance with a second or alternate embodiment of the invention will be described in conjunction with FIGS. 7 and 8. This system is useful with an engine powering a watercraft as illustrated in FIGS. 1–3 and described above.

In accordance with this embodiment of the invention, the system includes means for disabling the firing of all of the cylinders of the engine with a first frequency when the engine speed exceeds a first speed, and for disabling the firlng of all of the cylinders of the engine with a second frequency which exceeds the first frequency when the engine speed exceeds a second speed which exceeds the first speed.

In particular, once the engine 22 is running, the control 132 is arranged to detect whether the engine speed reaches a first engine speed (step S1'). In the embodiment illustrated in FIG. 8, the predetermined high speed is 7025 rpm. If the engine speed (as detected by the sensor 130) has not reached the first speed, the control 132 simply continues to monitor the engine speed.

If the engine speed exceeds the first speed, then the system is arranged so that the control 132 controls the ignition with a first disabling factor (step S2'). In accordance with this disabling factor, each cylinder 74*a,b,c* is disabled 25% of the time, or 1 out of every 4 normal firing times, such that the ignition element corresponding to each cylinder fires 3 out of every 4 revolutions of the crankshaft. In other words, each cylinder is disabled or prevented from firing with a certain frequency.

The engine speed is checked to see if it has exceeded a second predetermined speed (step S3'). This speed is preferably higher than the first predetermined high speed (such as 7075 rpm vs. 7025 rpm). If the engine speed is below this second speed, the above-referenced steps are repeated.

If the engine speed exceeds the second speed, then the system is arranged to that the control 132 controls the ignition with a second disabling factor (step S4'). In accordance with this disabling factor, each cylinder 74*a,b,c* is disabled 50% of the time, or 2 out of every 4 normal firing times, such that the ignition element corresponding to each cylinder only fires 2 out of every 4 revolutions of the crankshaft.

The engine speed is then checked to see if it has exceeded a third predetermined speed (step S5'). This speed is preferably higher than the second predetermined high speed (such as 7125 rpm vs. 7075 rpm). If the engine speed is below this third speed, the above-referenced steps are repeated.

If the engine speed exceeds the third speed, then the system is arranged to that the control 132 controls the ignition with a third disabling factor (step S6'). In accordance with this disabling factor, each cylinder 74*a,b,c* is disabled 75% of the time, or 3 out of every 4 normal firing times, such that the ignition element corresponding to each cylinder only fires 1 out of every 4 revolutions of the crankshaft.

The engine speed is then checked to see if it has exceeded a fourth predetermined speed (step S7'). This speed is preferably higher than the fourth predetermined high speed (such as 7175 rpm vs. 7125 rpm). If the engine speed is below this fourth speed, the above-referenced steps are repeated.

If the engine speed exceeds the fourth speed, then the system is arranged to that the control 132 controls the ignition with a fourth disabling factor (step S8'). In accordance with this disabling factor, each cylinder 74*a,b,c* is disabled 100% of the time, or every normal firing times, such that ignition element associated with each cylinder never fires.

The engine speed is then again checked in accordance with the steps described above.

This embodiment system has the advantage that until the engine speed exceeds a very high speed, none of the cylinders are disabled, but simply the frequency of their firing is reduced as the engine speed increases. This system provides for a generally smooth running engine even when the restriction system is restricting the speed of the engine.

Of course, the foregoing description is that of preferred embodiments of the invention, and various changes and modifications may be made without departing from the spirit and scope of the invention, as defined by the appended claims.

What is claimed is:

1. An engine speed restriction system for an internal combustion engine having at least two combustion chambers, an ignition system including an ignition element corresponding to each of said combustion chambers, and means for sensing a speed of said engine, said speed restriction system arranged to control the speed of said engine in a first range of engine speed by solely controlling the timing of firing said ignition elements, said system including means for controlling engine speed in a second engine speed range solely by disabling the firing of a first number of said ignition elements, and means for controlling engine speed in a third engine speed range by disabling the firing of a number of said ignition elements and controlling the timing of firing the remaining of said ignition elements.

2. The engine speed restriction system in accordance with claim 1, wherein said engine includes a crankshaft and said means for sensing a speed of said engine senses a rotational speed of said crankshaft.

3. The engine speed restriction system in accordance with claim 2, wherein said crankshaft of said engine is arranged to drive a water propulsion device of a watercraft.

4. The engine speed restriction system in accordance with claim 1, wherein the first speed range is lower than the second and third speed ranges and the speed is reduced by retarding a firing of each ignition element.

5. The engine speed restriction system in accordance with claim 1, wherein in the third speed range said means advances a firing timing of said ignition element of said combustion chambers which are not disabled.

6. An engine speed restriction system for an internal combustion engine having at least two combustion chambers, an ignition system including an ignition element corresponding to said combustion chamber, and means for sensing a speed of said engine, said speed restriction system arranged to reduce a speed of said engine if said engine speed exceeds a predetermined speed, said system including means for disabling a firing of all combustion chambers in a first frequency if said engine speed exceeds a first engine speed and said means disabling all combustion chambers in a second frequency exceeding said first frequency if said engine speed exceeds a second speed greater than said first speed.

7. The engine speed restriction system in accordance with claim 6, wherein said engine has a crankshaft and said means for sensing a speed of said engine senses a rotational speed of said crankshaft.

8. The engine speed restriction system in accordance with claim 6, wherein said means disables every firing of all of said combustion chambers above said second engine speed.

9. A speed restriction system for an internal combustion engine having at least two cylinders, an ignition element corresponding to each of said cylinders, a piston mounted in each of said cylinders, each piston connected to a crankshaft arranged for rotation with respect to a remainder of said engine, means for detecting a speed of said engine by sensing rotation of said crankshaft, said restriction system including means for disabling all of said cylinders in accordance with a first disabling factor when said engine speed exceeds a first speed and for disabling all of said cylinders in accordance with a second disabling factor exceeding said first factor when said engine speed exceeds a second speed greater than said first speed.

10. The speed restriction system in accordance with claim 9, wherein said first and second factors comprise the frequency with which the ignition elements corresponding to all cylinders are not fired per normal firing intervals therefor.

11. A speed restriction system for an internal combustion engine having at least two cylinders, an ignition element corresponding to each of said cylinders, a piston mounted in each of said cylinders, each piston connected to a crankshaft arranged for rotation with respect to a remainder of said engine, means for detecting a speed of said engine by sensing rotation of said crankshaft, said restriction system including means firing said ignition elements in accordance with a first disabling factor when said engine speed is in a first engine speed range, means for increasing a said firing disabling factor to a second factor when said engine speed exceeds said first engine speed range, and means for advancing said ignition firing timing of said ignition elements that are fired when said engine speed exceeds said first engine speed range.

12. The speed restriction system in accordance with claim 11, wherein said first disabling factor is zero and no ignition elements are disabled.

13. The speed restriction system in accordance with claim 14, wherein said second factor is one divided by the number of cylinders of said engine.

14. The speed restriction system in accordance with claim 11, wherein said restriction means causes the firing of said ignition element associated with one of said cylinders to be disabled in accordance with said firing disabling factor.

15. The speed restriction system in accordance with claim 11, wherein said restriction means causes the firing of said ignition element associated with all of said cylinders to be disabled in accordance with said firing disabling factor.

* * * * *